US006629665B2

(12) United States Patent
Okeyoshi

(10) Patent No.: US 6,629,665 B2
(45) Date of Patent: Oct. 7, 2003

(54) PAPER WEB FEEDER IN ROTARY PRESS

(75) Inventor: Tsuyoshi Okeyoshi, Tokyo (JP)

(73) Assignee: Kabushiki Kaisha Tokyo Kikai Seisakusho (JP)

( * ) Notice: Subject to any disclaimer, the term of this patent is extended or adjusted under 35 U.S.C. 154(b) by 0 days.

(21) Appl. No.: 10/131,889

(22) Filed: Apr. 25, 2002

(65) Prior Publication Data

US 2003/0057316 A1 Mar. 27, 2003

(30) Foreign Application Priority Data

Sep. 21, 2001 (JP) ..... 2001-289862

(51) Int. Cl.[7] ..... B65H 19/10; B65H 16/02

(52) U.S. Cl. ..... 242/559.2

(58) Field of Search ..... 242/559.2, 554.3, 242/555.5, 555.6, 555.7, 533.4, 533.5, 533.6, 474.5, 474.6

(56) References Cited

U.S. PATENT DOCUMENTS

| | | | | | |
|---|---|---|---|---|---|
| 2,097,053 | A | * | 10/1937 | Zalesak | 242/554.3 |
| 2,969,930 | A | * | 1/1961 | Zernov | 242/533.5 |
| 3,062,467 | A | * | 11/1962 | Chase et al. | 242/555.5 |
| 3,253,795 | A | * | 5/1966 | Penrod et al. | 242/555.6 |
| 3,529,785 | A | | 9/1970 | Mistele | |
| 3,796,388 | A | * | 3/1974 | Davis | 242/533.5 |
| 5,909,856 | A | | 6/1999 | Myer et al. | |

FOREIGN PATENT DOCUMENTS

| | | |
|---|---|---|
| JP | 389668 | 6/1938 |
| JP | 11299182 | 10/1999 |

OTHER PUBLICATIONS

European Search report dated Feb. 7, 2003 which issued in connection with corresponding European patent application. English translated claims of the above–referenced Japanese Application No. 38–9668.

* cited by examiner

*Primary Examiner*—John M. Jillions
(74) *Attorney, Agent, or Firm*—Trexler, Bushnell, Giangiorgi, Blackstone & Marr, Ltd.

(57) ABSTRACT

A paper web feeder is provided, which allows easy operations of maintenance and replacement to be achieved on occurrence of a malfunction. In addition, even if the number of wires is increased and connection means is up-sized due to expanded functions of support arms, no influence is given to bearings in support frames for a rotary shaft. A paper web feeder (A) for a rotary press comprises a pair of support frames (16, 17) opposing to each other. A rotary shaft (1) is rotatably supported by the pair of support frames (16, 17). Support arms (3, 4) are provided in plural and radial about the rotary shaft (1) for supporting a paper web (Q1, Q2, Q3) rotatably at each arm tip and configured to rotate integrally with the rotary shaft (1). Rotary conduction means (B) is located at a displaceable angle associated with rotation of the rotary shaft (1) for conducting to an electric device. The electric device displaces in angle associated with rotation of the rotary shaft (1). Stationary conduction means (C) is secured on either of the pair of support frames (16, 17) and conductive to the rotary conduction means (B). Connection means (D) is provided for electrically connecting the rotary conduction means (B) to the stationary conduction means (C). The rotary shaft (1) has axial ends, at least one of the axial ends protruded outside from the pair of support frames (16, 17). The rotary shaft (1) also has a hollow portion (1*a*, 2*a*) formed therein extending from a mid-portion between the pair of support frames (16, 17) to the portion protruded outside from the pair of support frames (16, 17). The stationary conduction means (C) and the connection means (D) are provided outside the pair of support frames (16, 17). The rotary conduction means (B) has a portion extended through the hollow portion (1*a*, 2*a*) to outside the pair of support frames (16, 17) and electrically connected to the connection means (D).

2 Claims, 5 Drawing Sheets

PAPER WEB FEEDER IN ROTARY PRESS

CROSS-REFERENCE TO RELATED APPLICATION

This application is based on and claims the benefit of priority from prior Japanese Patent Application No. 2001-289862, filed on Sep. 21, 2001, the entire content of which is incorporated herein by reference.

BACKGROUND OF THE INVENTION

1. Field of the Invention

The present invention relates to a paper web feeder for a rotary press, which comprises a rotary shaft rotatably supported by a pair of support frames opposing to each other; support arms provided in plural and radial about the rotary shaft for supporting a paper web rotatably at each arm tip; rotary conduction means located at a displaceable angle associated with rotation of the rotary shaft; stationary conduction means secured on the pair of support frames; and connection means for electrically connecting the rotary conduction means to the stationary conduction means.

2. Description of the Related Art

In such the paper web feeder, it is often required to supply an electric current between the rotary shaft and an electric device that is provided on radial support arms for supporting webs of paper attached on the rotary shaft. In this case, it is publicly known to employ, for example, a mechanism that includes a slip ring provided on the rotary shaft and a brush contacted with the slip ring (see JP 38-9668B publication).

In this mechanism, an electric wire extending from the slip ring to the electric device is, for example, installed through a narrow space between a support frame and radial support arms as shown in FIG. 5. In a conventional paper web feeder A' shown in FIG. 5, a pair of support frames 37, 38 are employed to rotatably support a rotary shaft 30, which is provided with web supports E' for supporting paper webs Q'. The rotary shaft 30 is also provided with a pair of support arms 31, 32, each composed of three arms arranged in radial at an equal angular interval about the rotary shaft 30 or in a three-forked shape.

At an appropriate location on the support frame 37, for example, on the outer side of the frame 37, a controller F' is provided to control operations of the web supports E'. On parts of the rotary shaft between the support frame 37 and the support arm 31 and between the support frame 38 and the support arm 32, a connection means D' is provided, respectively, which comprises a slip ring mechanism consisting of a slip ring and a brush (not depicted).

This connection means D' employs a slip ring and a brush for electrically connecting an electric wire, which displaces in angle associated with rotation of the rotary shaft 30, with an electric wire, which extends from the controller F' and is secured on the support frame 37 (38), to make conduction between them. In the connection means D', the slip ring opposes and contacts to the brush. The slip ring is provided in coaxial with the rotary shaft 30 on the outer surface of the rotary shaft 30 to rotate integrally with the rotary shaft 30. The brush is secured on the inner surface of the support frame 37 (38).

A cable 33 (34), which is a rotary connection means B', wired from the web support E' is connected to the slip ring. A cable 35 (36), which is a stationary connection means C', wired from the controller F' is connected to the brush.

In the conventional paper web feeder A', however, the connection means D' is provided on either or both parts of the rotary shaft between the support frame 37 and the support arm 31 and between the support frame 38 and the support arm 32. In this case, due to the narrow location space for the connection means, it is extremely difficult to execute a maintenance operation for the connection means D' if any malfunction occurs in the connection means D'. Further, if the need for replacement of the connection means arises, a large-scale operation is required, for example, to remove the rotary shaft 30 from the support frames 37, 38.

In addition, automatization of the paper web feeder requires many electric devices to be located on the support arms 31, 32. Consequently, it is required to provide an increased number of connection terminals on the connection means D' for electrically conducting these many electric devices to the stationary conduction means C'. For example, if the connection means D' is a slip ring mechanism, it is required to increase the number of slip rings and brushes for configuring the connection terminals, resulting in a wider space required for the connection means D'. If a gap between the support frames 37 and 38 is widened, a gap between bearings for the rotary shaft 30 is also widened. This increases an amount of flexure of the rotary shaft 30, losing stability in the web support, and inviting a delay in the automatization of the paper web feeder.

SUMMARY OF THE INVENTION

The present invention has an object to provide a paper web feeder, which allows easy operations of maintenance and replacement to be achieved on occurrence of a malfunction. In addition, even if the number of wires is increased and connection means is up-sized due to expanded functions of support arms, no influence is given to bearings in support frames for a rotary shaft.

To achieve the above object, the present invention is provided with a paper web feeder for a rotary press. The paper web feeder comprises a pair of support frames opposing to each other; a rotary shaft rotatably supported by the pair of support frames; support arms provided in plural and radial about the rotary shaft for supporting a paper web rotatably at each arm tip and configured to rotate integrally with the rotary shaft; rotary conduction means located at a displaceable angle associated with rotation of the rotary shaft for conducting to an electric device, the electric device displacing in angle associated with rotation of the rotary shaft; stationary conduction means secured on either of the pair of support frames and conductive to the rotary conduction means; and connection means for electrically connecting the rotary conduction means to the stationary conduction means. The rotary shaft has axial ends, at least one of the axial ends protruded outside from the pair of support frames. The rotary shaft also has a hollow portion formed therein extending from a mid-portion between the pair of support frames to the portion protruded outside from the pair of support frames. The stationary conduction means and the connection means are provided outside the pair of support frames. The rotary conduction means has a portion extended through the hollow portion to outside the pair of support frames and electrically connected to the connection means.

As obvious from the above, in the paper web feeder according to the present invention, the stationary conduction means and the connection means are provided outside the pair of support frames. Therefore, when a malfunction occurs in the connection means, its maintenance and replacement can be easily performed. In addition, no connection means is provided in between the support frame and the support arm. Therefore, it is possible to narrow a gap between the bearings in the pair of support frames for the rotary shaft.

Preferably, in the paper web feeder according to the present invention, the mid-portion of the rotary shaft between the pair of support frames and the portion protruded outside from the pair of support frames each have at least one opening formed therein for communicating with the hollow portion to introduce the rotary conduction means through the opening to inside and outside the hollow portion.

BRIEF DESCRIPTION OF THE DRAWINGS

The present invention will be more fully understood from the following detailed description with reference to the accompanying drawings in which.

DETAILED DESCRIPTION OF THE PREFERRED EMBODIMENTS

Figure 1:
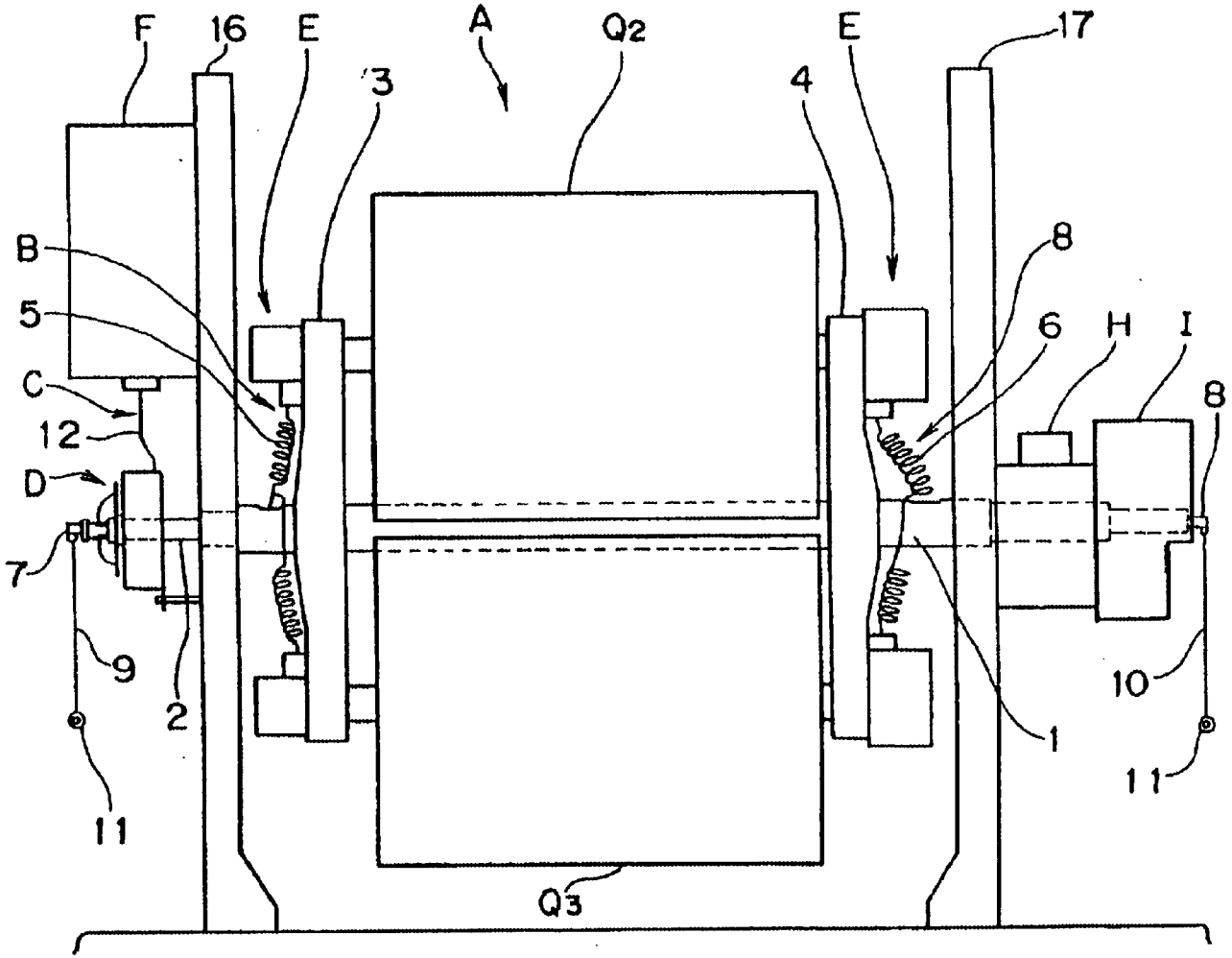
FIG. 1 is an outlined front view showing an embodiment of a paper web feeder in a rotary press according to the present invention.
Figure 2:
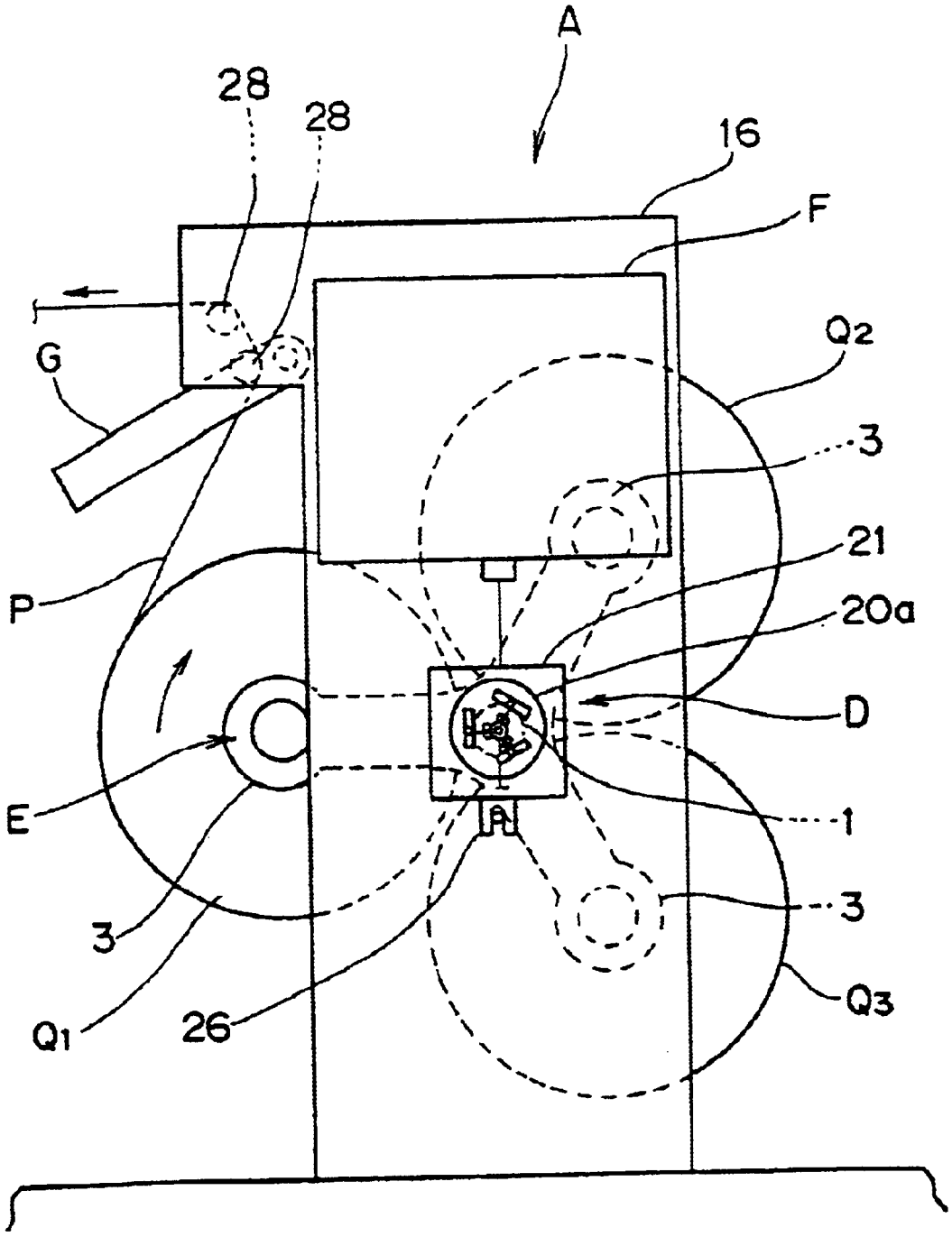
FIG. 2 is an outlined side view showing the paper web feeder according to the same embodiment.
Figure 3:
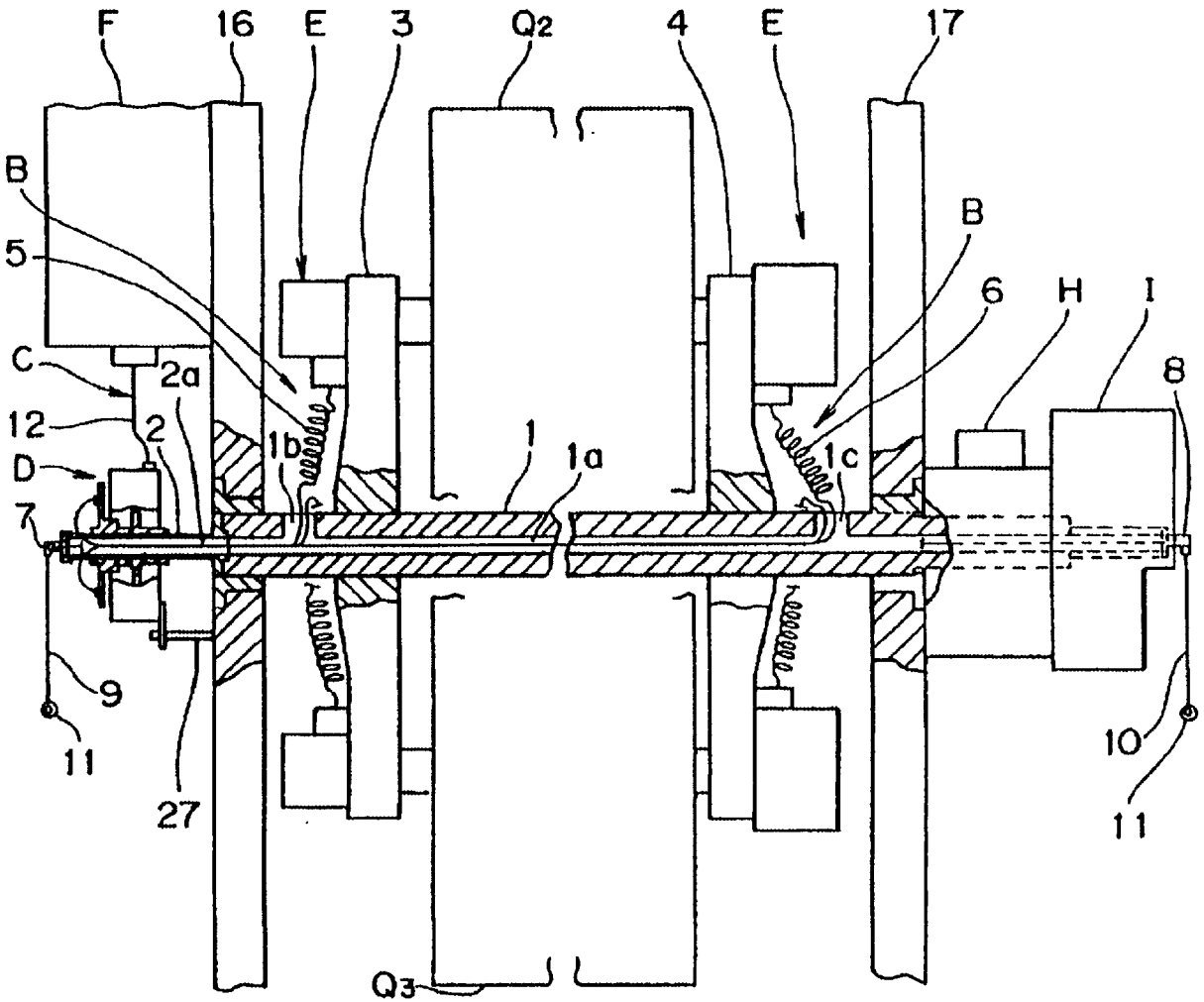
FIG. 3 is a partly enlarged cross-sectional view of the rotary shaft in FIG. 1.
Figure 4:
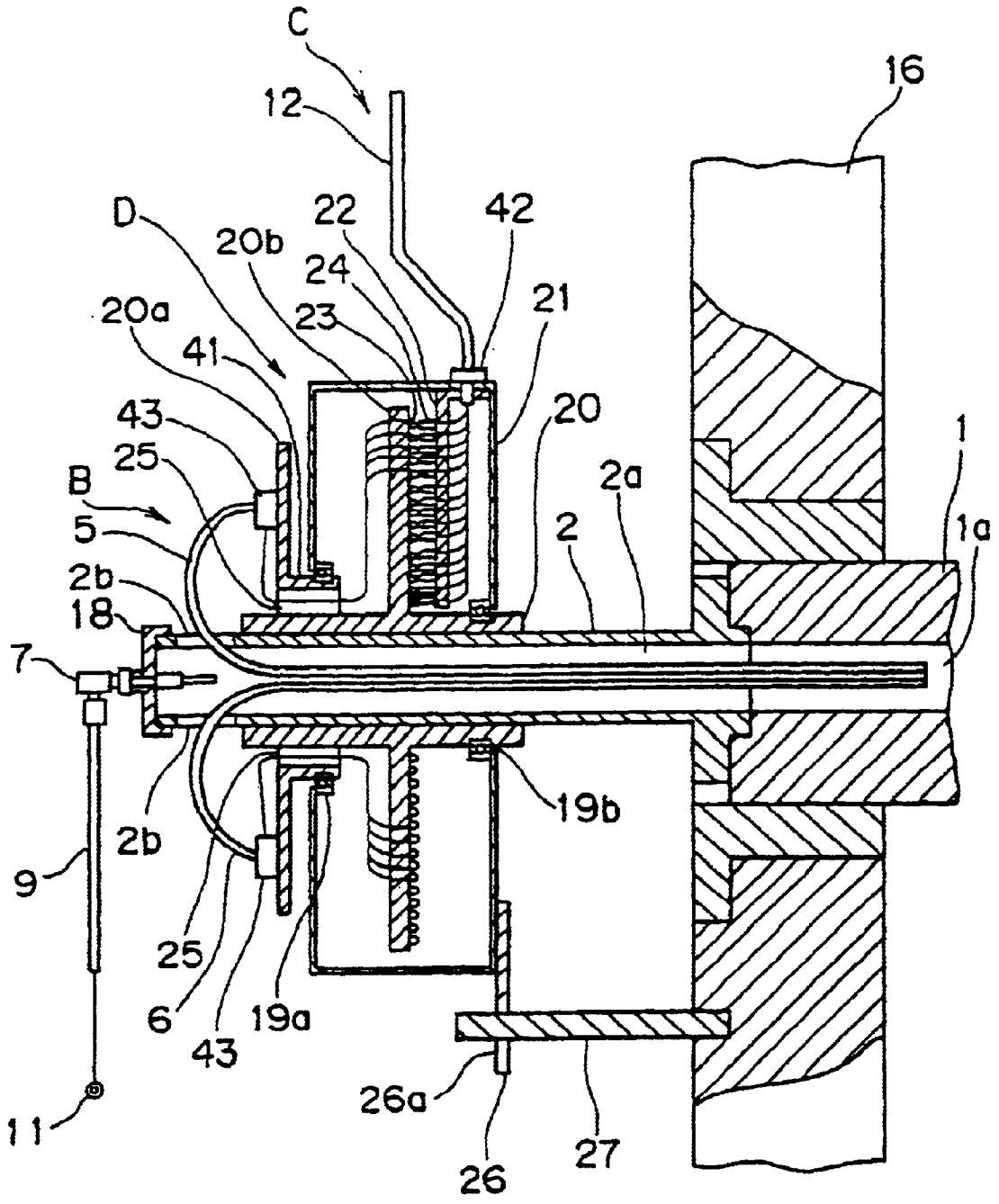
FIG. 4 is a partly enlarged cross-sectional view of the connection means in FIG. 1.
Figure 5:
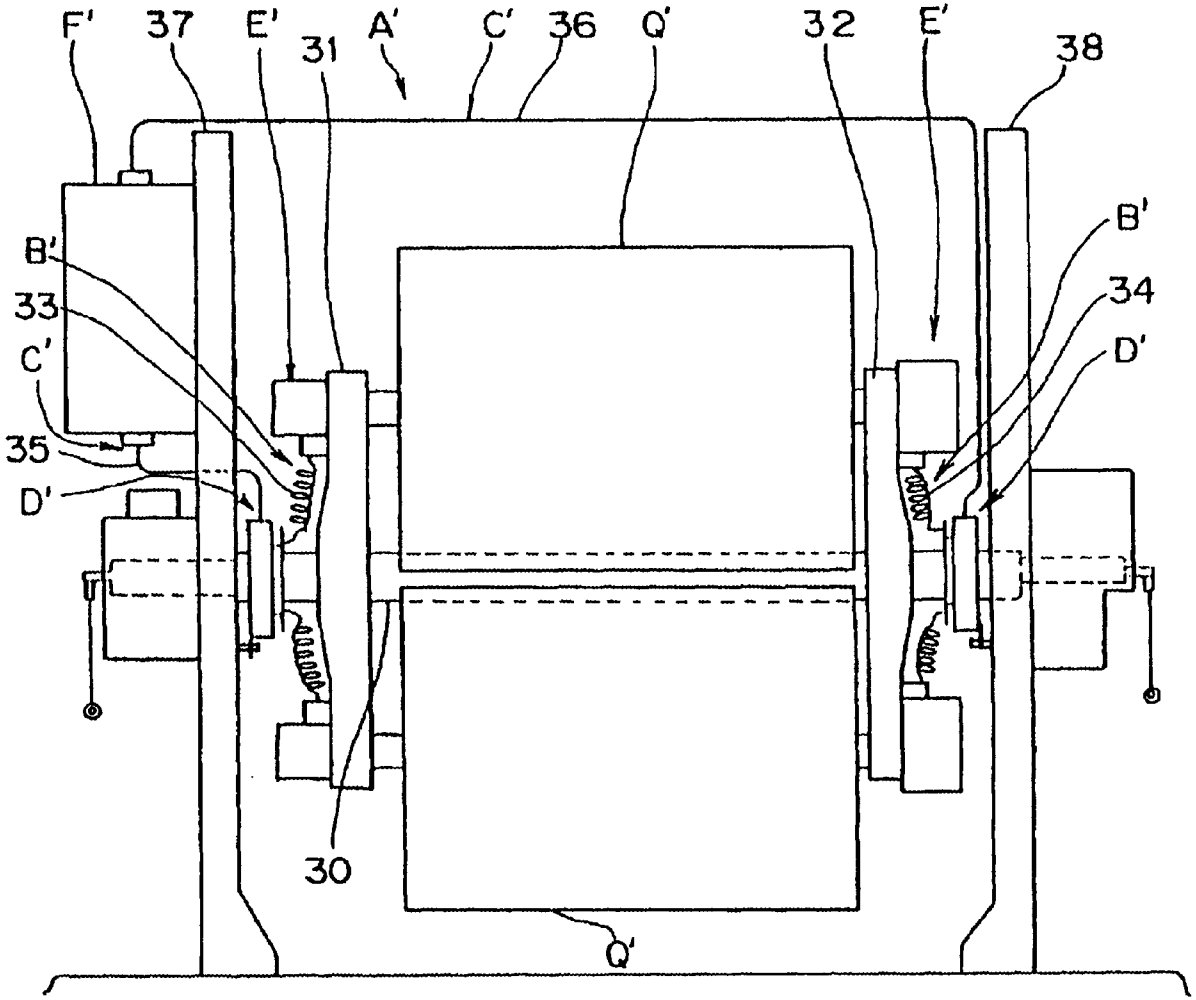
FIG. 5 Prior Art
FIG. 5 is an outlined front view of a conventional paper web feeder in a rotary press.

Next, an embodiment of a paper web feeder in a rotary press according to the present invention will be described with reference to the drawings. FIG. 1 is an outlined front view showing an arrangement of the paper web feeder according to this embodiment, and FIG. 2 is the corresponding outlined side view. FIG. 3 is a partly enlarged cross-sectional view of the rotary shaft in FIG. 1, and FIG. 4 is a partly enlarged cross-sectional view of the connection portion in FIG. 1. The paper web feeder A according to the embodiment comprises, as shown in FIG. 1, a pair of support frames 16, 17 opposing to each other; a rotary shaft 1 rotatably supported by the pair of support frames 16, 17; a pair of support arms 3, 4 comprising web supports E for supporting a paper web Q1 (Q2, Q3); rotary conduction means B located at a displaceable angle associated with rotation of the rotary shaft 1 for conducting to an electric device, which displaces in angle associated with rotation of the rotary shaft 1; stationary conduction means C secured on the pair of support frames 16, 17 and conductive to the rotary conduction means B; connection means D for electrically connecting the rotary conduction means B to the stationary conduction means C; a controller F for controlling operations of the web supports E and a rotator H provided at an axial end of the rotary shaft 1 for rotating the rotary shaft 1.

From the web Q1, a running paper P is pulled out, as shown in FIG. 2, then the running paper P is guided by guide rollers 28 and conveyed to a printing unit (not depicted). A paper jointer G is arranged at a location where an operation of paper jointing is performed to the running paper P. In this embodiment, the paper jointer G is operative to joint the web Q2 to the running paper P in the following manner. Namely, when the web Q1 is gradually consumed as the rotary press runs and the running paper P is pulled out, the rotator H operates to rotate the rotary shaft 1. The rotary shaft 1 rotates in the counterclockwise direction in FIG. 2. After a reserved part of the web Q2 displaces in angle and stops at a location in the vicinity of the running paper P, the paper jointer G turns operative to perform a paper jointing operation for jointing the web Q2 to the running paper P.

As shown in FIG. 1, a side lay I is arranged together with the rotator H at the axial end of the rotary shaft 1. This side lay I is employed to move the rotary shaft 1 in the axial direction. This is required immediately after the paper jointer G performs the paper jointing of the web Q2 to shift the edge of the running paper P to the standard location, positioning the running paper P at a certain location. The controller F is provided on the outer side of the frame 16.

The rotary shaft 1 is rotatably supported by the pair of support frames 16, 17 in such the manner that both axial ends thereof protrude from the support frames 16, 17. It has a hollow portion 1*a* therein that extends from one end to the other as shown in FIG. 3. A sleeve 2 is provided at the axial end of the rotary shaft 1 near the support frame 16 so that it can be integrated with the rotary shaft 1. The sleeve 2 has a hollow portion 2*a* formed therein with the same diameter as that of the hollow portion 1*a* in the rotary shaft 1. Namely, the sleeve 2 and the hollow portion 2*a* thereof form an axial end of the rotary shaft 1 protruded from the support frame 16 and the hollow portion 1*a* therein (see FIG. 4). In the circumference in the vicinity of the tip of the sleeve 2, plural openings 2*b* are formed in communication with the hollow portion 2*a*. A cap 18 is attached on the tip of the sleeve 2.

An air conduit 9 is led from an air source 11 and coupled through a rotary joint 7 to the cap 18. Another air conduit 10 is also led from the air source 11 and coupled through a rotary joint 8 to the tip of the other axial end of the rotary shaft 1 protruded from the support frame 17. Extending through the hollow portion 1*a* in the rotary shaft 1 and appearing from later-described openings 1*b*, 1*c* to outside of the rotary shaft 1, these air conduits 9, 10 are led to pneumatic instruments (not depicted) provided on the support arms 3, 4.

A pair of support arms 3, 4 are separately provided in the vicinity of the support frames 16, 17 for the rotary shaft 1. The support arms 3, 4 are each composed of three arms arranged in radial at an equal angular interval about the rotary shaft 1 or in a three-forked shape to rotate integrally with the rotary shaft. A paper web Q1 (Q2, Q3) is rotatably supported on each of tips of the support arms 3 and 4 that are located opposite to each other. In parts of the rotary shaft 1 between the support frame 16 and the support arm 3 and between the support frame 17 and the support arm 4, openings 1*b*, 1*c* are formed in communication with the hollow portion 1*a*.

The rotary conduction means B comprise, as shown in FIG. 3, cables 5, 6 led to electric devices such as electromagnetic valves and detector (not depicted) for members integrally rotatable with the rotary shaft 1. The members are, for example, the support arms 3, 4 and the web supports E provided on the arm tips thereof. These cables 5, 6 are introduced from the electric devices into the hollow portion 1*a* through the openings 1*b*, 1*c* of the rotary shaft 1. They are further introduced, through the hollow portion 1*a* and the hollow portion 2*a* in the sleeve 2 that configures one axial end of the rotary shaft 1, from the opening 2*b* to outside the sleeve 2 and connected electrically to the connection means D.

The stationary conduction means C comprises a cable 12 that is led to the controller F provided on the outer side of the support frame 16. The cable 12 is configured to electrically connect the controller F to the connection means D.

As shown in FIG. 4, the connection means D is provided on the sleeve 2 that configures one axial end of the rotary shaft 1 protruding outside from the frame 16. The connection means D comprises, at a location closer to the support frame 16 than the opening 2*b* in the outer circumference of the sleeve 2, a cylindrical ring base 20 secured over the whole circumference of the sleeve 2, and a case 21 rotatably arranged relative to the ring base 20 through a pair of bearings 19*a*, 19*b* for covering the outer circumference of the ring base 20.

In the vicinity of the outside end of the ring base 20 (the left side in FIG. 4), there is a large-diameter portion 41 stepped from the ring base 20. On the outer circumference of the outside end of the large-diameter portion 41, a disc-like terminal plate 20*a* expanding in radial is provided. At a location designed slightly inside from the center in the axial direction of the ring base 20, a disc-like ring plate 20*b* standing in radial is provided.

In the large-diameter portion 41 of the ring base 20, plural bores 25 are formed in parallel with the axial direction of the sleeve 2. On a side of the ring plate 20*b* that does not face the terminal plate 20*a*, plural slip rings 23 are provided concentrically with the sleeve 2. The slip rings 23 are attached in a condition electrically insulated from the ring plate 20*b*.

In the pair of bearings interposed between the ring base 20 and the case 21, one 19*a* is located on the outer circumference in the vicinity of the inner end of the large-diameter portion 41 (the right side in FIG. 4) and the other 19*b* is located on the outer circumference in the vicinity of the inner end of the ring base 20. The case 21 is provided to house the ring plate 20*b* therein. A rotation stopper 26 having a notch 26*a* formed at the tip thereof is provided outward in a radial direction on a surface of the case 21 facing the support frame 16. On the outer side of the support frame 16, a rod-like guide 27 extending in parallel with the axial direction of the sleeve 2 is provided. The guide 27 is engaged in the notch 26*a* of the rotation stopper 26, having a minimum clearance therebetween. Therefore, when the rotation stopper 26 is engaged with the guide 27, the case 21 is prevented from rotating in the same rotational direction as that of the rotary shaft 1. When the rotator H and/or the side lay I operate simultaneously or separately, the rotary shaft 1 rotates and/or axially shifts. In this case, the case 21 does not rotate together with the sleeve 2. Rather, it is guided by the guide 27 and simply shifted in the axial direction together with the rotary shaft 1.

On the upper portion inside the case 21, an L-shaped bracket 22 is provided facing a surface of the ring plate 20*b* that is employed to locate the slip rings 23 thereon. Plural brushes 24, each electrically contacting with each of the slip rings 23 provided on the ring plate 20*b*, are arranged on a surface of the bracket 22 opposite to the ring plate 20*b*. These brushes 24 are electrically insulated from the bracket 22.

A terminal block 42 is provided on the upper surface of the case 21. The cable 12, which is the stationary conduction means C, is wired and connected to each of the brushes 24 in the case 21 through the terminal block 42.

Another terminal block 43 is provided on a surface of the terminal plate 20*a* not facing the case 21. The cable 5, which is the rotary conduction means B, is wired and connected to the slip rings in the case 21 through the terminal block 43 and the bore 25.

In the paper web feeder A according to this embodiment, the stationary conduction means C wired from the controller F is electrically connected to the rotary conduction means B that is provided through the hollow portion 1*a* in the rotary shaft 1, by means of the connection means D that comprises the slip ring mechanism provided on the axial end of the rotary shaft 1.

The rotary conduction means B is wired to the electric devices for the web supports E on the support arms 3, 4. When the rotator H operates, the rotary shaft 1 rotates and the web supports E displace in angle. In this state, as the rotary conduction means B and the stationary conduction means C are electrically connected through the connection means D, the rotary conduction means B can communicate electric signals with the controller F without troubles.

As obvious from the forgoing, according to the paper web feeder for a rotary press in the present invention, as the stationary conduction means and the connection means for connecting the stationary conduction means to the rotary connection means are provided outside the support frames, it is possible to perform extremely easy operations of maintenance and replacement on occurrence of a malfunction in the connection means and a rapid operation of restoration. Consequently, it is possible to improve the availability factor of the paper web feeder.

In addition, without elongating the gap between the support frames, it is possible to increase the number of electric wires connected to the electric devices provided on the radial support arms and proceed the development of functions of the machine without troubles.

Having described the embodiments consistent with the invention, other embodiments and variations consistent with the invention will be apparent to those skilled in the art. Therefore, the invention should not be viewed as limited to the disclosed embodiments but rather should be viewed as limited only by the spirit and scope of the appended claims.

What is claimed is:

1. A paper web feeder for a rotary press, comprising:

a pair of support frames opposing to each other;

a rotary shaft rotatably supported by said pair of support frames;

support arms provided in plural and radial about said rotary shaft for supporting a paper web rotatably at each arm tip and configured to rotate integrally with said rotary shaft;

rotary conduction means located at a displaceable angle associated with rotation of said rotary shaft for conducting to an electric device, said electric device displacing in angle associated with rotation of said rotary shaft;

stationary conduction means secured on either of said pair of support frames and conductive to said rotary conduction means; and connection means for electrically connecting said rotary conduction means to said stationary conduction means, wherein said rotary shaft has axial ends, at least one of said axial ends protruded outside from said pair of support frames, said rotary shaft also having a hollow portion formed therein extending from a mid-portion between said pair of support frames to said portion protruded outside from said pair of support frames, said stationary conduction means and said connection means are provided outside said pair of support frames, and said rotary conduction means has a portion extended through said hollow portion to outside said pair of support frames and electrically connected to said connection means.

2. The paper web feeder according to claim 1, wherein said mid-portion of said rotary shaft between said pair of support frames and said portion protruded outside from said pair of support frames each have at least one opening formed therein for communicating with said hollow portion to induce said rotary conduction means through said opening to inside and outside said hollow portion.

* * * * *

US006629665C1

(12) EX PARTE REEXAMINATION CERTIFICATE (5460th)

United States Patent
Okeyoshi

(10) Number: US 6,629,665 C1
(45) Certificate Issued: Jul. 25, 2006

(54) PAPER WEB FEEDER IN ROTARY PRESS

(75) Inventor: Tsuyoshi Okeyoshi, Tokyo (JP)

(73) Assignee: Kabushiki Kaisha Tokyo Seisakusho, Tokyo (JP)

Reexamination Request:
No. 90/006,958, Mar. 10, 2004

Reexamination Certificate for:

| | |
|---|---|
| Patent No.: | **6,629,665** |
| Issued: | **Oct. 7, 2003** |
| Appl. No.: | **10/131,889** |
| Filed: | **Apr. 25, 2002** |

(30) Foreign Application Priority Data

Sep. 21, 2001 (JP) ..... 2001-289862

(51) Int. Cl.
*B65H 19/10* (2006.01)
*B65H 16/02* (2006.01)

(52) U.S. Cl. ..... 242/559.2; 439/21; 439/22

(58) Field of Classification Search ..... 439/20, 439/21, 22, 27

See application file for complete search history.

(56) References Cited

U.S. PATENT DOCUMENTS

| | | | | | |
|---|---|---|---|---|---|
| 1,596,557 | A | * | 8/1926 | Scholes | 439/22 |
| 2,097,053 | A | * | 10/1937 | Zalesak | 242/554.3 |
| 2,725,540 | A | * | 11/1955 | Scott | 439/21 |
| 2,889,531 | A | * | 6/1959 | Ellerman et al. | 439/20 |
| 3,062,467 | A | * | 11/1962 | Chase et al. | 242/555.5 |

FOREIGN PATENT DOCUMENTS

JP 61159836 10/1986

* cited by examiner

*Primary Examiner*—Peter C. English

(57) ABSTRACT

A paper web feeder is provided, which allows easy operations of maintenance and replacement to be achieved on occurrence of a malfunction. In addition, even if the number of wires is increased and connection means is up-sized due to expanded functions of support arms, no influence is given to bearings in support frames for a rotary shaft. A paper web feeder (A) for a rotary press comprises a pair of support frames (16, 17) opposing to each other. A rotary shaft (1) is rotatably supported by the pair of support frames (16, 17). Support arms (3, 4) are provided in plural and radial about the rotary shaft (1) for supporting a paper web (Q1, Q2, Q3) rotatably at each arm tip and configured to rotate integrally with the rotary shaft (1). Rotary conduction means (B) is located at a displaceable angle associated with rotation of the rotary shaft (1) for conducting to an electric device. The electric device displaces in angle associated with rotation of the rotary shaft (1). Stationary conduction means (C) is secured on either of the pair of support frames (16, 17) and conductive to the rotary conduction means (B). Connection means (D) is provided for electrically connecting the rotary conduction means (B) to the stationary conduction means (C). The rotary shaft (1) has axial ends, at least one of the axial ends protruded outside from the pair of support frames (16, 17). The rotary shaft (1) also has a hollow portion (1*a*, 2*a*) formed therein extending from a mid-portion between the pair of support frames (16, 17) to the portion protruded outside from the pair of support frames (16, 17). The stationary conduction means (C) and the connection means (D) are provided outside the pair of support frames (16, 17). The rotary conduction means (B) has a portion extended through the hollow portion (1*a*, 2*a*) to outside the pair of support frames (16, 17) and electrically connected to the connection means (D).

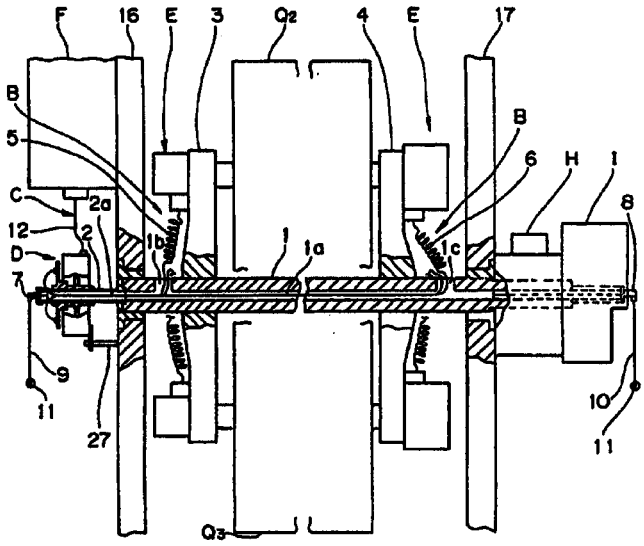

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1 and 2 are cancelled.

New claim 3 is added and determined to be patentable.

*3. The paper web feeder according to claim 1, further comprising a side lay employed to move said rotary shaft in an axial direction;*

*said connection means further comprising a ring base, on which slip rings electrically connecting said rotary conduction means are arranged so as to rotate together with said rotary shaft, and a case, on which a rotation stopper having a notch to engage a guide arranged in parallel with said rotary shaft and brushes electrically contacting said slip rings and electrically connecting said stationary conduction means are provided, the case being rotatably arranged to said ring base; and*

*said connection means is arranged on an axial end of said rotary shaft protruding outside from said pair of support frames so as to shift in an axial direction together with said rotary shaft when said rotary shaft moves in an axial direction.*

* * * * *